US006923840B2

(12) United States Patent
Schutz et al.

(10) Patent No.: US 6,923,840 B2
(45) Date of Patent: Aug. 2, 2005

(54) FLEXIBLE ABRASIVE PRODUCT AND METHOD OF MAKING AND USING THE SAME

(75) Inventors: James W. Schutz, Woodbury, MN (US); Stacee L. Royce, St. Paul, MN (US); Michael J. Annen, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/919,840

(22) Filed: Aug. 17, 2004

(65) Prior Publication Data

US 2005/0020190 A1 Jan. 27, 2005

Related U.S. Application Data

(60) Division of application No. 10/137,134, filed on Apr. 30, 2002, which is a continuation-in-part of application No. 09/706,033, filed on Nov. 3, 2000, now abandoned, and a continuation-in-part of application No. 09/850,661, filed on May 7, 2001, now abandoned.

(51) Int. Cl.[7] ..... B24D 3/00; B24D 18/00; B24D 11/00

(52) U.S. Cl. ..... 51/307; 51/295; 51/298; 51/308; 51/309; 451/28; 451/41

(58) Field of Search ..... 51/307, 308, 309, 51/298, 295; 451/28, 41

(56) References Cited

U.S. PATENT DOCUMENTS

| | | | |
|---|---|---|---|
| 4,055,029 | A | 10/1977 | Kalbow |
| 4,311,489 | A | 1/1982 | Kressner |
| 4,318,766 | A | 3/1982 | Smith |
| 4,652,275 | A | 3/1987 | Bloecher et al. |
| 4,751,138 | A | 6/1988 | Tumey et al. |
| 4,799,939 | A | 1/1989 | Bloecher et al. |
| 4,903,440 | A | 2/1990 | Larson et al. |
| 4,985,340 | A | 1/1991 | Palazzotto et al. |
| 5,014,468 | A | 5/1991 | Ravipati et al. |
| 5,152,917 | A | 10/1992 | Pieper et al. |
| 5,236,472 | A | 8/1993 | Kirk et al. |
| 5,396,737 | A | 3/1995 | Englund et al. |
| 5,435,816 | A | 7/1995 | Spurgeon et al. |
| 5,667,541 | A | 9/1997 | Klun et al. |
| 5,714,259 | A | 2/1998 | Holmes et al. |
| 5,849,051 | A | 12/1998 | Beardsley et al. |
| 5,910,471 | A | 6/1999 | Christianson et al. |
| 5,958,794 | A | 9/1999 | Bruxvoort et al. |
| 6,007,407 | A | 12/1999 | Rutherford et al. |
| 6,007,590 | A | 12/1999 | Sanders, Jr. |
| 6,024,634 | A | 2/2000 | Hoglund et al. |
| 6,059,850 | A | 5/2000 | Lise et al. |
| 6,375,559 | B1 | 4/2002 | James et al. |
| 6,769,969 | B1 | 8/2004 | Duescher |

FOREIGN PATENT DOCUMENTS

| | | |
|---|---|---|
| DE | G 94 07 622.7 | 8/1994 |
| EP | 0 306 162 B1 | 8/1988 |
| EP | 0 316 161 B1 | 8/1988 |
| WO | WO 97/42004 | 11/1997 |
| WO | WO 00/03840 | 1/2000 |
| WO | WO 02/42034 A1 | 5/2002 |

*Primary Examiner*—Michael A Marcheschi
(74) *Attorney, Agent, or Firm*—Richard Francis

(57) ABSTRACT

The present invention provides a flexible abrasive product comprised of an open cell foam backing, a foraminous barrier coating and a shaped foraminous abrasive coating. The flexible abrasive article of the invention is made by applying a curable barrier coating over an open cell foam backing, curing the curable barrier coating to provide a foraminous barrier coating having openings therethrough corresponding to openings in the open cell foam, applying a coating composition comprising a curable binder and abrasive particles over the foraminous barrier coating, imparting a textured surface to the coating composition with a production tool which has a textured surface which is the inverse of the textured surface of the abrasive coating and to which production tool textured surface any coating composition coated over an opening of the first major surface may adhere, at least partially curing the binder, and separating the production tool from the textured surface to provide the shaped foraminous abrasive coating.

13 Claims, 8 Drawing Sheets

FLEXIBLE ABRASIVE PRODUCT AND METHOD OF MAKING AND USING THE SAME

RELATED APPLICATION

This is a divisional application of allowed continuation-in-part having U.S. Ser. No. 10/137,134, filed Apr. 30, 2002, which is a continuation-in-part application of U.S. Ser. No. 09/706,033, now abandoned, filed on Nov. 3, 2000 and U.S. Ser. No. 09/850,661, now abandoned, filed on May 7, 2001, each of which is incorporated herein by reference.

FIELD OF THE INVENTION

The present invention relates generally to flexible abrasive articles, such as abrasive sponges. More particularly, the present invention relates to a flexible abrasive product comprised of a foam backing and a shaped abrasive coating.

BACKGROUND OF THE INVENTION

The use of abrasive products to finish the painted surface of a repaired portion of an automobile is well known. The original painted exterior surfaces of automobiles have a unique "orange peel" surface that is desirably duplicated when repairs are made. While prior coated abrasive products and abrasive slurries, either alone or in combination, typically in the presence of a liquid medium such as water, have been used to finish such surfaces, finishing techniques that use these products have produced less than optimal results.

Various patents disclose products and/or processes which are said to be useful for finishing painted automotive surfaces. See for example, EP 0 771 613 B1, published Apr. 5, 2000, WO 00/03840, published 27 Jan. 2000 based on U.S. patent application Ser. No. 09/116,038 filed Jul. 15, 1998, and U.S. Pat. No. 6,024,634.

Several problems are encountered by use of finishing products and/or techniques that are known in the art. These include the inability to provide a finished orange peel surface that duplicates the original surface. Additionally, some products encounter unwanted sticking to or grabbing between the moistened painted surface being finished and the surface of the abrasive product as it is rotated, for example on a "dual action" sander, or otherwise moved against the surface being finished. Other products are difficult to use. Some are thin with a pressure-sensitive adhesive attachment system and are difficult to remove from a release liner and, when attached to a support pad, are not easily deployed wrinkle-free.

A need exists for a flexible abrasive product which will refine a painted exterior automotive surface to provide a surface finish which, after a subsequent glazing step, substantially duplicates the original painted surface substantially without disturbing the orange peel. A need also exists for a flexible abrasive product which, when used under wet conditions with a dual action sander, will not grab the surface being finished.

SUMMARY OF THE INVENTION

This invention provides a flexible abrasive product, a method of making the same and a method of using the same. The novel abrasive product, when used under wet conditions to refine a painted exterior automotive surface which, after a subsequent glazing step, provides a surface finish which substantially duplicates the original painted surface without substantially disturbing the orange peel. In use with a dual action sander under conventional wet conditions, the novel flexible abrasive product will not grab or stick to the surface being finished.

In one embodiment, the invention provides a flexible abrasive article comprising:

a. foam backing having a minimum thickness of at least 2 mm, a first major surface and an opposite second major surface; and b. a shaped abrasive coating over said first major surface of the foam backing comprised of abrasive particles in a binder.

The foam backing in this embodiment may be a closed cell foam or an open cell foam.

In a further embodiment, the invention provides a flexible abrasive article which comprises:

a. an open cell foam backing having a first major surface and an opposite second major surface;

b. a foraminous barrier coating over said first major surface; and c. a shaped foraminous abrasive coating over the foraminous barrier coating comprised of abrasive particles in a binder.

The open cell foam preferable is in sheet form with planar major surfaces, but other surface-configurations are also useful. For example, the second major surface may be planar to facilitate attachment and the first major surface, i.e., the surface to which the abrasive coating will be applied, may be other than planar, such as an undulated or convoluted surface. Such convoluted foams are disclosed in U.S. Pat. No. 5,007,128, incorporated herein by reference.

While the flexible abrasive product according to the invention may be used by hand without an attachment system, it typically includes an attachment system on the second surface for attaching the abrasive article to a support pad. Such attachment system may include, for example, one part of a hook and loop fastening system with the other part of the hook or loop being on the support pad of the sander or abrasive tool which will be utilized to move the flexible abrasive product. Other types of fastening systems may include a coating of pressure-sensitive adhesive of a pressure-sensitive adhesive composition which is attachable to a smooth surface on the support pad of the tool.

In one embodiment the flexible abrasive article is made by a method which comprises the following steps:

a. providing a foam backing having a minimum thickness of at least 2 mm, a first major surface, and an opposite second major surface;

b. adhering to the second major surface one part of a two part attachment sheet material to provide dimensional stability to foam backing;

c. applying a shaped coating composition comprising a curable binder and abrasive particles over said first major surface of foam backing, said coating composition being curable to provide a shaped abrasive coating; and d. curing the curable binder.

The flexible abrasive article of the invention in a further embodiment, is made by a method which comprises the following steps:

a. applying a curable barrier coating over a first major surface of an open cell foam backing which also has an opposite second major surface;

b. curing the curable barrier coating to provide on the first major surface a foraminous barrier coating having openings therethrough corresponding to openings in the open cell foam;

c. applying a coating composition comprising a curable binder and abrasive particles over the foraminous barrier coating;

d. imparting a textured surface to the coating composition applied in step c with a production tool that has a textured surface which is the inverse of the textured surface of the abrasive coating and to which production tool textured surface any coating composition coated over an opening in the first major surface may adhere;

e. at least partially curing the binder; and f. separating the production tool from the textured surface to provide the shaped foraminous abrasive coating characterized by having openings therethrough corresponding to at least some of the openings in the open cell foam.

Alternatively, the flexible abrasive product may be made by the following method:

a. coating a curable barrier coating composition which will cure to form an impervious coating on the first major surface of the open cell foam;

b. curing the curable barrier coating composition to provide an impervious barrier coating;

c. applying a coating composition comprising abrasive particles and curable binder curable to provide an abrasive coating over the cured impervious barrier coating;

d. imparting a textured surface to the uncured coating composition of step c;

e. curing the coating composition to provide a shaped abrasive coating over the impervious barrier coating; and f. perforating the impervious barrier coating and shaped abrasive coating to provide the flexible abrasive product having the foraminous barrier coating and the foraminous shaped abrasive coating.

The invention further provides a method of finishing a surface of a substrate, the method comprising the following steps:

a. contacting a surface of the substrate with a flexible abrasive article comprising an open cell foam backing having a first major surface and an opposite second major surface; a foraminous barrier coating over said first major surface; and a shaped foraminous abrasive coating over said foraminous barrier coating comprised of abrasive particles in a binder; and b. relatively moving said flexible abrasive article in the presence of a liquid medium such as water to modify said surface of said substrate.

Throughout this application, the following definitions apply:

A "flexible" abrasive article refers to an abrasive article that is sufficiently flexible that it may be folded upon itself, yet on release will redeploy without permanent structural alterations to its original configuration.

A "foraminous" barrier coating is a barrier coating that is characterized by having porosity sufficient to permit liquid passage therethough.

A "shaped" abrasive coating refers to an abrasive coating comprised of abrasive particles in a binder that has other than the typical topographic surface as may be encountered in conventional coated abrasive products, but instead would have a textured surface having raised portions and recessed portions which may be in an ordered or a random pattern.

A shaped "foraminous" abrasive coating is a shaped abrasive coating that is characterized by having porosity sufficient to permit liquid passage throughout its area.

An "impervious" coating refers to a coating that has properties which are the opposite of those of a foraminous coating, i.e., it has substantially no porosity which will permit liquid passage.

The various aspects of the invention will be better understood from the following description of figures and the preferred embodiments of the invention.

DETAILED DESCRIPTION OF THE INVENTION

The flexible abrasive product of the invention may be prepared by coating an open cell foam backing with a barrier coating composition, e.g., by roll coating, spray coating or curtain coating, curing the barrier coating composition, e.g., in a forced air oven heated at the curing temperature of the barrier coating composition to provide the coated backing bearing a foraminous barrier coating.

Figure 1:
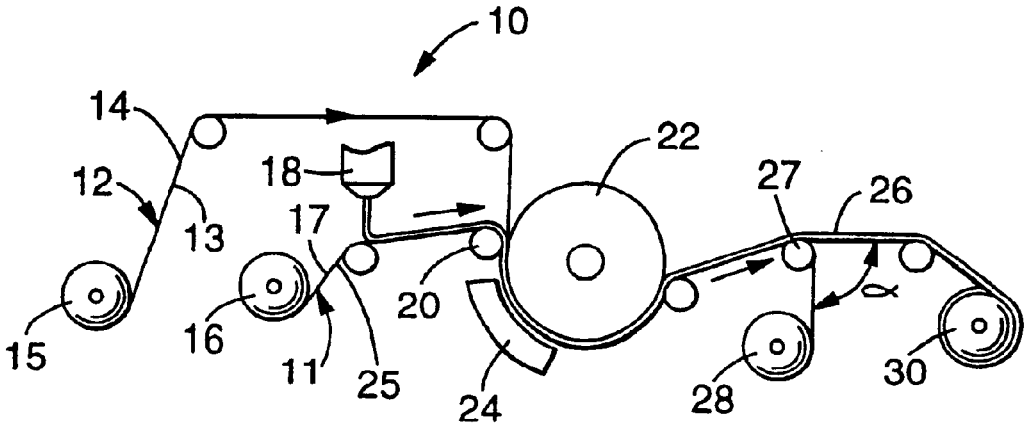
FIG. 1 is a schematic representation of one process for making a flexible abrasive article according to the present invention.

The barrier coated backing may be coated with an abrasive coating according to the method described in U.S. Pat. No. 5,435,816 or U.S. Pat. No. 5,667,541, incorporated herein by reference. FIG. 1 illustrates an apparatus 10 for applying the shaped foraminous abrasive coating to the barrier coated backing to provide an abrasive article according to the invention. A production tool 11 is in the form of a belt having two major surfaces and two ends. An open cell foam backing 12 having a first major surface 13 bearing a foraminous barrier coating and a second major surface 14 is unwound from roll 15. Open cell foam 12 is preferably attached at its leading edge to a plastic film carrier (not shown) with second major surface 14 disposed on the film to provide dimensional stability under tension to the open cell foam backing while it is being coated. Alternatively, open cell foam backing 12 is adhered on its second major surface 14 to one part of a two part attachment sheet material to provide the dimensional stability to the open cell foam backing. Preferably it is adhered to the film-backed part which bears the engaging elements. At the same time open cell foam backing 12 is unwound from roll 15, the production tool 11 is unwound from roll 16. The contacting surface 17 of production tool 11 is coated with a mixture of abrasive particles and binder precursor at coating station 18. The mixture can be heated to lower the viscosity thereof prior to the coating step. The coating station 18 can comprise any conventional coating means, such as knife coater, drop die coater, curtain coater, vacuum die coater, or an extrusion die coater. After the contacting surface 17 of production tool 11 is coated, the backing 12 and the production tool 11 are brought together such that the mixture wets the first major surface 13 of the backing 12. In FIG. 1, the mixture is forced into contact with the open cell foam backing 12 by means of a contact nip roll 20, which also forces the production tool/mixture/backing construction against a support drum 22. Next, a sufficient dose of radiation energy is transmitted by a source of radiation energy 24 through the back surface 25 of production tool 11 and into the mixture to at least partially cure the binder precursor, thereby forming a shaped, handleable structure 26. The production tool 11 is then separated from the shaped, handleable structure 26. Separation of the production tool 11 from the shaped handleable structure 26 occurs at roller 27. The angle $\alpha$ between the shaped, handleable structure 26 and the production tool 11 immediately after passing over roller 27 is preferably steep, e.g., in excess of 30°, in order to bring about clean separation of the shaped, handleable structure 26 from the production tool 11 except in the areas that were coated over openings in the foraminous barrier coated open cell foam backing 12. The coating tends to adhere to the production tool surface in these areas creating small openings in the abrasive coating which causes the abrasive coating to become foraminous. The production tool 11 is rewound as roll 28 so that it can be reused. Shaped, handleable structure 26 is wound as roll 30. If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. As used herein, the phrase "full cure" and the like means that the binder precursor is sufficiently cured so that the resulting product will function as an abrasive article, e.g. a coated abrasive article.

After the abrasive article is formed, it can be flexed and/or humidified prior to converting. The abrasive article can be converted into any desired form such as a cone, endless belt, sheet, disc, etc. before use.

Figure 2:
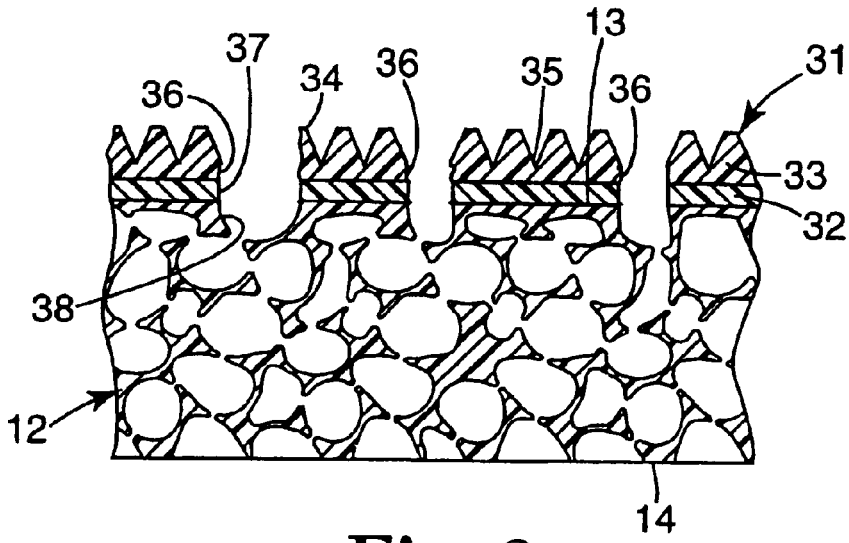
FIG. 2 is an enlarged schematic cross-sectional drawn representation of a portion of a flexible abrasive product according to the present invention.
Figure 3:
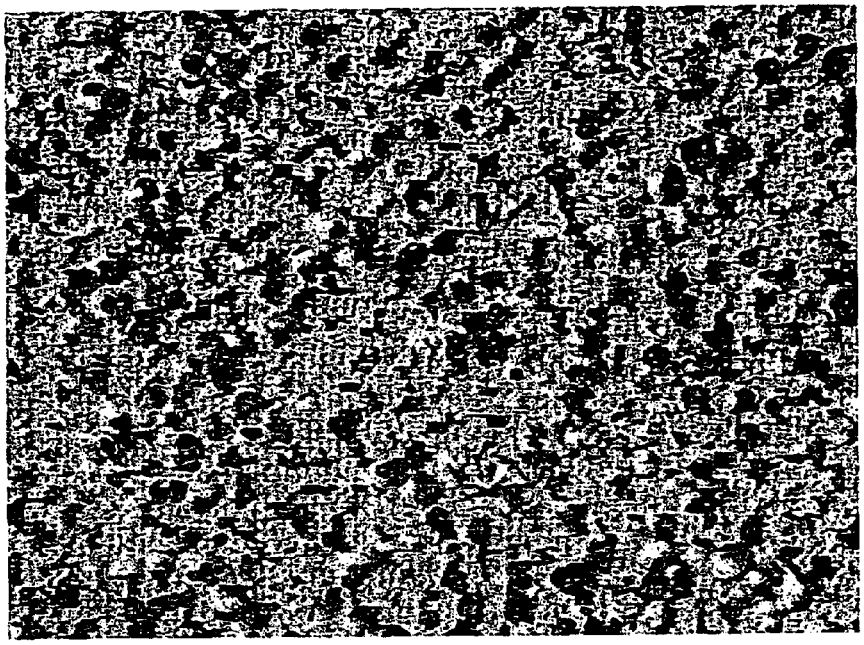
FIG. 3 is a photomicrograph taken at a magnification of 29× of the top surface of a flexible coated abrasive product made in accordance with the present invention.
Figure 4:
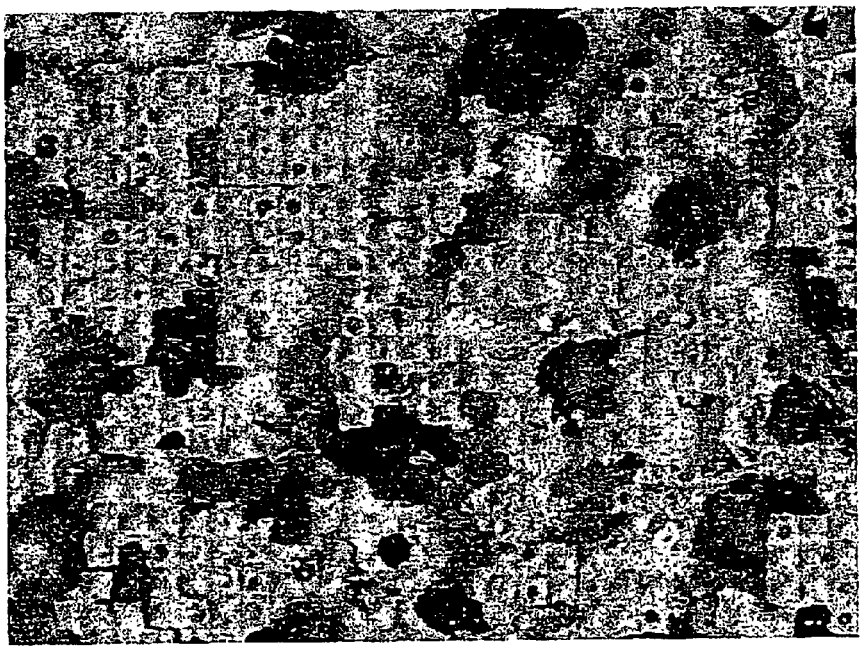
FIG. 4 is a photomicrograph taken at a magnification of 97× of the top surface of a flexible coated abrasive product: made in accordance with the present invention.

Referring now to FIG. 2, there is shown a flexible abrasive article 31 which includes an open cell foam backing 12 that has a major surface 13 and an opposite major surface 14. Major surface 13 is coated with a foraminous barrier coating 32 which, in turn in FIG. 2, is coated with a shaped foraminous abrasive coating 33 that is characterized by having raised portions 34, depressions 35 and openings 36. While barrier coating 32 is shown in FIG. 2 as an integral single layer having straight defined surfaces, its bottom surface penetrates into the surface of the open cell foam upon which it is coated, coating the individual strands of the open cell foam within its structure. Openings 36 in shaped foraminous abrasive coating 33 are characterized by being over openings 37 in barrier coating 32 which are over openings 38 in major surface 13 of open cell foam backing 12. Openings 36 are typically irregular in shape because of the irregular nature of the openings in the open cell foam backing 12, with few, if any, identical openings. This may be further appreciated by reference to FIGS. 3 and 4 of the drawings.

Figure 7:
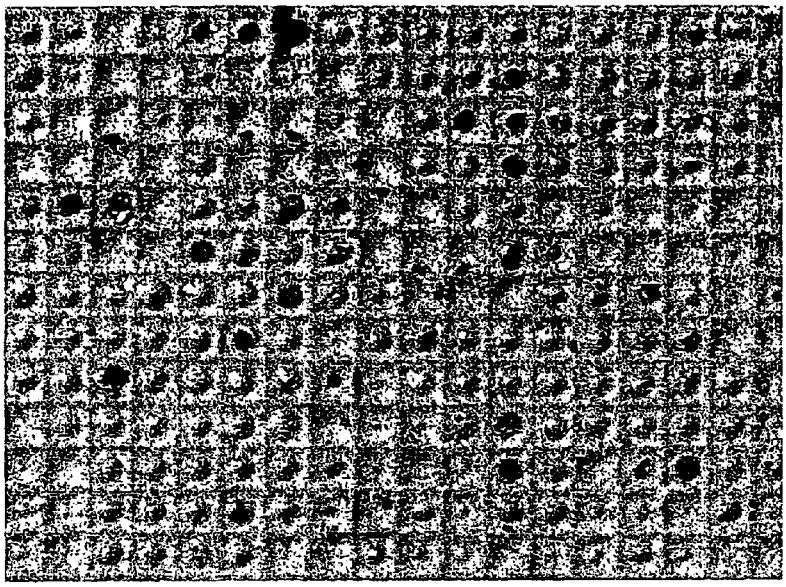
FIG. 7 is a photomicrograph taken at a magnification of 97× of the top surface of a precursor to the flexible coated abrasive product of the invention prior to being subjected to needle penetration.
Figure 8:
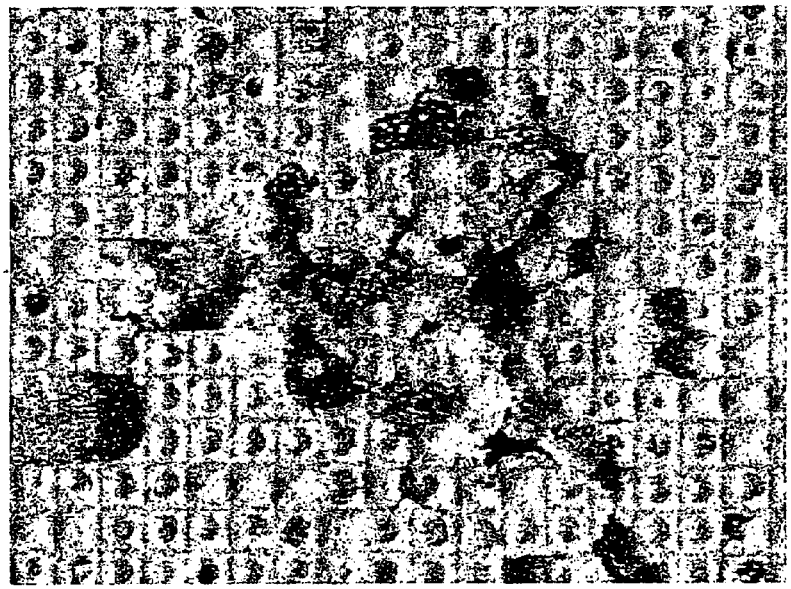
FIG. 8 is a photomicrograph taken at a magnification of 97× of the top surface of a flexible abrasive product made in accordance with the present invention resulting from needle penetration of the precursor shown in FIG. 7.
Figure 9:
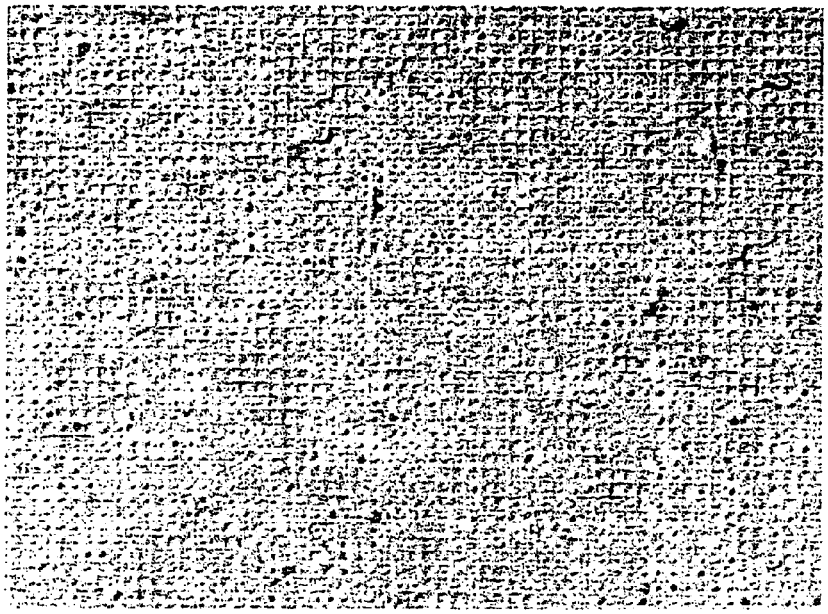
FIG. 9 is the precursor shown in FIG. 7, but at a magnification of 29× instead of 97×.
Figure 10:
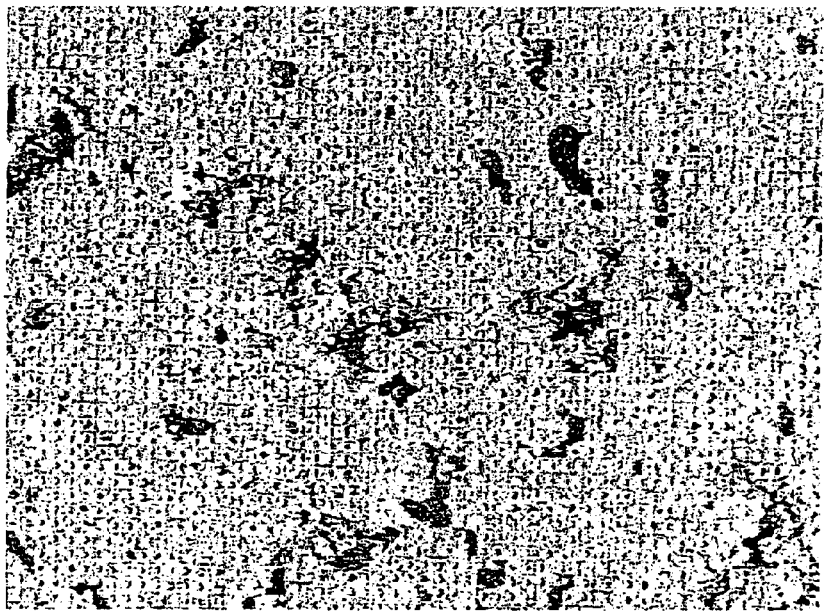
FIG. 10 is the product shown in FIG. 8, but at a magnification of 29× instead of 97×.

FIGS. 7 and 9, respectively, show the top surface of a precursor product which may be perforated by needle penetration to provide the coated abrasive product of the invention. FIGS. 8 and 10, respectively, show the perforated product. It will be noted in FIGS. 8 and 10 that the openings provided by the penetration of the needles causes the abrasive coating to fracture to provide openings which do not correspond to the needle shape but, in fact, are irregular with few openings being identical to each other. It is preferred that the needles only penetrate the foraminous layer and the shaped abrasive layer, but not the backing layer, since it is already porous.

Foam Backing

In general, any open cell foam resilient backing with coatable surfaces on at least one surface may be used in the abrasive articles of the invention. Such foams preferably have a sheet-like configuration with planar major surfaces, although foams with one or both major surfaces being other than planar are also useful. Such surfaces may include a plurality of depressions or a plurality of projections which respectively may vary widely in depth, height, spacing, diameter and shape. Useful foam substrates have an elongation ranging from about 85 to about 150% (ire., the stretched length of the foam minus the unstretched length of the foam all divided by the unstretched length of the foam and then multiplied by 100 equals 85 to 150%.). Specific embodiments of the invention include open cell foam substrates having elongation values of approximately 100 to 150%. The thickness of the foam substrate is only limited by the desired end use of the abrasive article. Preferred foam substrates have a thickness in the range of about 1 mm to about 50 mm, although substrates having a greater thickness can also be used.

Figure 16:
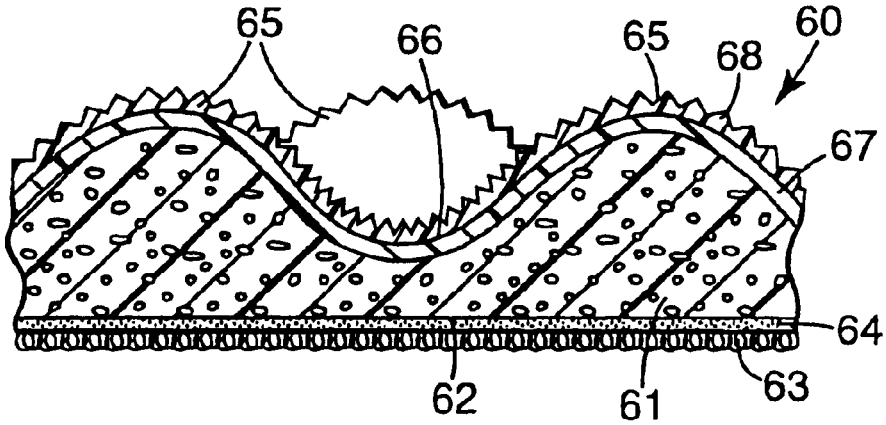
FIG. 16 is an enlarged sectional view of a segment of flexible abrasive product of the present invention comprising a convoluted open cell foam backing.

The major surfaces of the open cell foam resilient backing may be either planar or ordered nonplanar, i.e., they may be contoured into a regular array of projecting portions and recessed portions as shown in FIG. 16. Such ordered nonplanar foams may be prepared by, e.g., the process depicted in FIG. 8 of U.S. Pat. No. 5,396,737 (Englund and Schwartz), incorporated herein by reference. Foams containing ordered nonplanar surfaces created by this process are sometimes referred to as "convoluted foams." Ordered nonplanar foams may also be made by casting, molding, cutting, thermoforming, etc. The first and second major surfaces may both be planar, may both be ordered nonplanar, or may comprise one planar and one ordered nonplanar surface. In the event that an ordered nonplanar open cell foam backing is employed, an ordered nonplanar first major surface and a generally planar second major surface is preferred. Ordered nonplanar surfaces may have projecting portions disposed in a regular rectangular or square array and/or may include ridge portions extending between projecting portions. The recessed portions can define a rectangular array of sockets with each of the sockets being bounded by ridges between four adjacent projection portions. Projecting portions may extend from about 1 mm to about 65 mm from the opposite major surface. Recessed portions may extend from about 0.5 mm to about 25 mm from the opposite major surface. The difference between the distance between a projecting portion and the opposite major surface and the distance between a recessed portion and the opposite major surface is from about 0.5 mm to about 64 mm.

FIG. 16 shows a segment 60 of a flexible abrasive product having an open cell foam backing 61 which has a planar back surface 62 to which is adhered an attachment means 63 (the hook part of a hook and loop fastener) by adhesive layer 64. The front face of backing 61 has an array of projecting portions 65 and low portions 66. This surface is covered with a foraminous coating 67 over which is coated a shaped foraminous abrasive coating 68.

The dimensions of a rectangular array of projecting portions and recessed portions are somewhat dependent on the method by which the array is produced. Preferably, the distance between adjacent projecting and recessed features is 0.03 to 40 mm, more preferably 1 mm to 25 mm, and most preferably 2 to 12 mm. Preferably, the distance between adjacent projecting portions is between 1.5 mm and 50 mm, more preferably between 3 mm and 25 mm, and most preferably between 5 mm and 15 mm.

Figure 5:
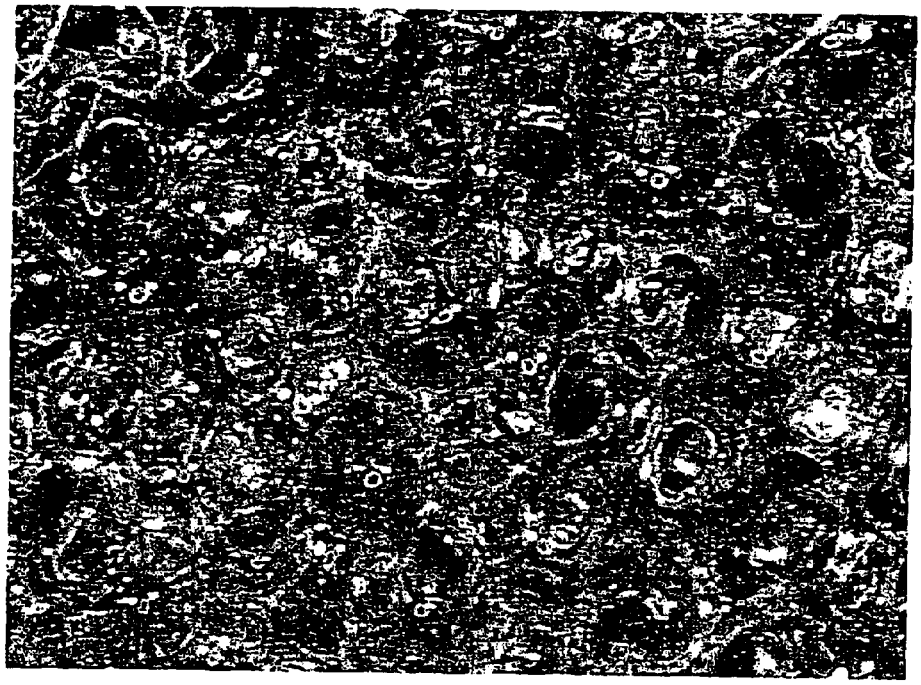
FIG. 5 is a photomicrograph taken at a magnification of 97× of the top surface of an open cell foam backing used to make the flexible coated abrasive product of the invention.
Figure 6:
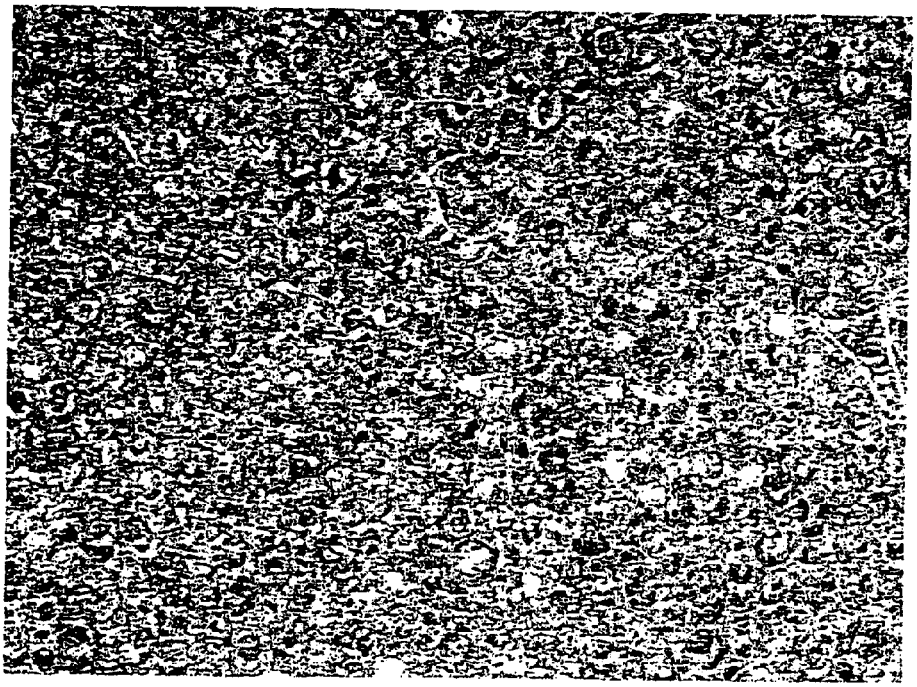
FIG. 6 is a photomicrograph taken at a magnification of 29× of the open cell foam backing shown in FIG. 5.

The open cell foam backing of the flexible abrasive product of the invention typically is in a sheet-like form most preferably with a minimum thickness of at least about 2 mm and preferably with a bulk density as determined by ASTM D-3574 of greater than about 0.03 gram per $cm^3$ (2 lbs per $ft^3$). Useful embodiments of open cell foam backings have bulk densities of about 0.03 to about 0.10 grams per $cm^3$ (1.8–6 lbs per $ft^3$). While thinner and/or lighter open cell foams may be useful, they may require special handling because they are somewhat more difficult to process on conventional coating equipment. The open cell foam backing preferably is formed of a foam having sufficient porosity to permit the entry of liquid water. The nature of the openings in the open cell foam backing may be appreciated by referring to FIGS. 5 and 6. A simple test for air porosity will reveal whether the open cell foam has adequate water permeability. The test for air porosity is accomplished according to ASTM D-3574 which test employs an air flow apparatus such as the Frazier™ differential pressure air permeability measuring instrument (low pressure model) manufactured by Frazier Instrument Company, Hagerstown, Md. Results are reported as cubic feet of air per minute per square foot of sample at a pressure differential of 0.5 inch of water or cubic meters of air per minute per square meter of sample at a pressure difference of 12.7 mm of water. Useful open cell foams have been found to have an air permeability of at least 1 (0.305 $m^3$/minute/$m^2$), preferably from about 2 to about 50 (0.61 to 15.3 $m^3$/minute/$m^2$), most preferably from about 10 to about 60 $ft^3$/minute/$ft^2$ at 0.5 inch pressure differential (3.05 to 18.3 $m^3$/minute/$m^2$ at a pressure difference of 12.7 mm of water). It should be noted that these air permeability values apply to the open cell foam after the barrier coat has been applied and to open cell foam sheets having a thickness in the range of about 90 to about 188 mils (2.30 to 4.75 mm). The permeability values for open cell foams without the barrier coating may be higher and for thicker foams may be lower.

The materials generally found to be useful to be made into the open cell foam are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. Particular examples of useful open cell foams are polyester polyurethane foams, commercially available from illbruck, Inc., Minneapolis, Minn. under the illbruck, Inc. trade designations R 200U, R 400U, R 600U and EF3-700C. Particular examples of convoluted open cell foams are polyester polyurethane foams, commercially available from illbruck, Inc. under the trade designation MINI-STANDARD CONVOLUTES.

Barrier Coating

Preferred barrier coating compositions comprise a suitable coatable material such as a polymer dissolved or dispersed as a latex, for example, in a suitable liquid carrier material such as a solvent. Such compositions preferably are easily coated onto one major surface of the open cell foam substrate and, once coated, cured to provide a foraminous coating or a nonforaminous barrier coating that will later be perforated. Suitable materials for forming the foraminous barrier coating are acrylic latex emulsions that will coat the surface of the open cell foam backing without blocking the pores so that porosity remains after curing. A preferred composition for forming the foraminous barrier coating is an acrylic emulsion available from BF Goodrich, Cleveland, Ohio under the trade designation HyCar™ 2679 latex. The dry coating weight of barrier coating applied to the open cell foam preferably is at least 50 grams per square meter (gsm) and typically may vary between 65 gsm and 180 gsm.

Useful barrier coats which cure to provide an impervious coating which is later perforated to make it foraminous include an acrylic latex (e.g., HyCar™ 2679) which has been thickened to provide a coating composition that will not readily penetrate the open cell foam backing but instead will remain a surface layer which will cure to provide the impervious barrier coating. The acrylic emulsion is thickened by the addition of a thickening agent such as solution of a polyacrylic acid available under the trade designation Carbopol™ EZ-1 from BF Goodrich which has been thickened by the addition of an aqueous ammonium hydroxide solution which serves as an activator for the Carbopol™ EZ-1 polyacrylic acid solution. The dry coat weight of the barrier coating which will cure to provide an impervious coating is preferably at least 150 gsm and typically may vary between about 160 to 190 gsm. After curing, the impervious barrier coating is overcoated with a shaped coating comprised of curable binder and abrasive particles, which is then cured. Such coatings may be made foraminous by perforating the cured coatings preferably from the abrasive side with a staggered 20×20 array of needles (Foster™ 15×18×25×3.5 RB) deployed in a standard needle board with rows and columns being spaced ½ inch (1 cm) apart and operated at 37 strokes per 10 inch (25 cm) length to provide about 148 penetrations per square inch (about 6.5 $cm^2$). Such needles and a needle board may be obtained from Foster Needle Company, Inc., Manitowoc, Wis.

Shaped Abrasive Coating

The shaped foraminous abrasive coating is formed by providing a slurry of fine abrasive particles in a curable binder system.

As previously mentioned, the shaped foraminous abrasive coating is preferably made according to the method described in commonly assigned U.S. Pat. No. 5,435,816 (Spurgeon, et al.). Any of a variety of methods of forming a shaped coated abrasive coating may be employed to be applied to the impervious barrier coating. Such methods include, for example, that disclosed in Spurgeon, et al. in U.S. Pat. No. 5,435,816, that disclosed in Christianson, et al. in U.S. Pat. No. 5,910,471, that disclosed in Bruxvoort, et al. in U.S. Pat. No. 5,958,794, that disclosed in Pieper, et al., in U.S. Pat. No. 5,152,917 and that disclosed in Ravipati, et al., in U.S. Pat. No. 5,014,468, each of these patents being incorporated herein by reference.

In the event that ordered nonplanar open cell foam backings having projecting and recessed portions on a first major surface ("front" surface), the coating conditions are maintained such that when the production tool is applied to the projecting and recessed areas they are momentarily compressed into a planar configuration. Upon subsequent release of the compression, the projecting and recessed portions recover. Such momentary compression results in uniform coatings and shaped abrasive coatings having shaped features that are oriented normal to the surfaces of the various projecting and recessed areas.

The coatable composition which is curable to provide a shaped abrasive coating is then applied to the impervious barrier coating by a technique which imparts a texture to the abrasive layer to provide the shaped abrasive coating on curing. The shaped abrasive coating and impervious barrier coating over the open cell foam backing are then perforated by use of a suitable needle board to provide the necessary porosity through the abrasive article. Perforation is preferably from front (the abrasive side) to back to avoid discontinuities in the abrasive coating. The openings in a perforated shaped foraminous abrasive coating are characterized by being in a regular pattern, i.e., corresponding to the pattern of the needle board and web traverse which was used to form them, although the openings themselves are somewhat irregular in shape due to the fracturing of the abrasive coating as it is penetrated by the needles.

The mixture to be used to form the shaped abrasive coating, in either case, for application to a foraminous barrier coated open cell foam or to an impervious barrier coated open cell foam, comprises a plurality of abrasive particles dispersed in a binder precursor sometimes referred to as a curable binder. As used herein, the term "mixture" means any composition comprising a plurality of abrasive particles dispersed in a binder precursor. It is preferred that the mixture be flowable. However, if the mixture is not flowable, it can be extruded or forced by other means, e.g. heat or pressure or both, onto the contacting surface of the production tool or onto the front surface of the backing. The mixture can be characterized as being conformable, that is, it can be forced to take on the same shape, outline, or contour as the contacting surface of the production tool and the front surface of the open cell foam backing.

The abrasive particles typically have an average particle size ranging from about 0.1 to 1500 micrometers, usually from about 1 to 400 micrometers. It is preferred that the abrasive particles have a Mohs' hardness of at least about 8, more preferably above 9. However, the particles may have a Mohs' hardness value lower than 8 depending on intended use. Examples of abrasive particles suitable for use in this invention include fused aluminum oxide, ceramic aluminum oxide, heat treated aluminum oxide, white aluminum oxide, green silicon carbide, silicon carbide, alumina zirconia, diamond, ceria, cubic boron nitride, garnet, and combinations thereof The phrase "abrasive particles" includes both individual abrasive grits and a plurality of individual abrasive grits bonded together to form an agglomerate. Abrasive agglomerates are further described in U.S. Pat. Nos. 4,311,489; 4,652,275; and 4,799,939, incorporated herein by reference.

The binder precursor is capable of being cured by energy, preferably radiation energy, more preferably, radiation energy from ultraviolet light, visible light, or electron beam sources. Other sources of energy include infrared, thermal, and microwave. It is preferred that the energy not adversely affect the production tool used in the method of the invention, so that the tool can be reused. The binder precursor can polymerize via a free radical mechanism or a cationic mechanism. Examples of binder precursors that are capable of being polymerized by exposure to radiation energy include acrylated urethanes, acrylated epoxies, ethylenically,unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and combinations thereof The term "acrylate" includes acrylates and methacrylates.

Acrylated urethanes are diacrylate esters of hydroxy terminated NCO extended polyesters or polyethers. Examples of commercially available acrylated urethanes include that available under the trade name "UVITHANE™ 782," from Morton Thiokol Chemical, and those available under the trade designations "CMD 6600," "CMD 8400," and "CMD 8805," from Radcure Specialties.

Acrylated epoxies are diacrylate esters of epoxy resins, such as the diacrylate esters of bisphenol A epoxy resin. Examples of commercially available acrylated epoxies include those available under the trade designations "CMD 3500," "CMD 3600," and "CMD 3700," from Radcure Specialties.

Ethylenically unsaturated compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000. The preferred ethylenically unsaturated compounds are esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated compounds include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, trimethylopropane triacrylate, glycerol triacrylate, pentaerythritol triacrylate, pentaerythritol methacrylate, and pentaerythritol tetraacrylate. Other ethylenically unsaturated compounds include monoallyl, polyallyl, and polymethallyl esters and amides of carboxylic acids, such as diallyl phthalate, diallyl adipate, and N,N-diallyladipamide. Still other nitrogen-containing ethylenically unsaturated compounds include tris (2-acryloyloxyethyl)isocyanurate, 1,3,5-tri(2-methyacryloxyethy)-s-triazine, acrylamide, methylacrylamide, N-methylacrylamide, N,N-dimethylacrylamide, N-vinylpyrrolidone, and N-vinylpiperidone.

Aminoplast resins suitable for this invention have at least one pendant α,β-unsaturated carbonyl group per molecule or oligomer. These materials are further described in U.S. Pat. No. 4,903,440 and U.S. Pat. No. 5,236,472, both of which are incorporated herein by reference.

Isocyanurate derivatives having at least one pendant acrylate group and isocyanate derivatives having at least one pendant acrylate group are further described in U.S. Pat. No. 4,652,275, incorporated herein by reference. The preferred isocyanurate derivative is a tri-acrylate of tris(hydroxy ethyl)isocyanurate.

Epoxy resins have an oxirane ring and are polymerized by opening of the ring. Epoxy resins suitable for this invention include monomeric epoxy resins and oligomeric epoxy resins. Representative examples of epoxy resins preferred for this invention include 2,2-bis[4-(2,3-epoxypropoxy) phenylpropane](diglycidyl ether of bisphenol) and commercially available materials under the trade designation "Epon™ 828," "Epon™ 1004," and "Epon™ 1001F," available from Shell Chemical Co., under the trade designations "DER™-331," "DER™-332," and "DER™-334," available from Dow Chemical Co. Other epoxy resins suitable for this invention include glycidyl ethers of phenol formaldehyde novolac (e.g., under the trade designations "DEN™-431" and "DEN™-428," available from Dow Chemical Co.). Epoxy resins useful in this invention can polymerize via a cationic mechanism in the presence of one or more appropriate photoinitiators. These resins are further described in U.S. Pat. No. 4,318,766, incorporated herein by reference.

If either ultraviolet radiation or visible radiation is to be used, it is preferred that the binder precursor further comprise a photoinitiator. Examples of photoinitiators that generate a free radical source include, but are not limited to, organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil ketals, thioxanthones, acetophenone derivatives, and combinations thereof.

Cationic photoinitiators generate an acid source to initiate the polymerization of an epoxy resin. Cationic photoinitiators can include a salt having an onium cation and a halogen containing a complex anion of a metal or metalloid. Other cationic photoinitiators include a salt having an organometallic complex cation and a halogen containing complex anion of a metal or metalloid. These are further described in U.S. Pat. No. 4,751,138, incorporated herein by reference. Another example of a cationic photoinitiator is an organometallic salt and an onium salt described in U.S. Pat. No. 4,985,340; European Patent Applications 306,161; 306,162; all of which are incorporated herein by reference. Still other cationic photoinitiators include an ionic salt of an organometallic complex in which the metal is selected from the elements of Periodic Group IVB, VB, VIB, VIIB and VIIIB.

In addition to the radiation curable resins, the binder precursor may further comprise resins that are curable by sources of energy other than radiation energy, such as condensation curable resins. Examples of such condensation curable resins include phenolic resins, melamine-formaldehyde resins, and urea-formaldehyde resins.

The binder precursor can further comprise optional additives, such as, for example, fillers (including grinding aids), fibers, lubricants, wetting agents, surfactants, pigments, dyes, coupling agents, plasticizers, and suspending agents. An example of an additive to aid in flow properties has the trade designation "OX-50," commercially available from DeGussa. The amounts of these materials can be adjusted to provide the properties desired. Examples of fillers include calcium carbonate, silica, quartz, aluminum sulfate, clay, dolomite, calcium metasilicate, and combinations thereof. Examples of grinding aids include potassium tetrafluoroborate, cryolite, sulfur, iron pyrites, graphite, sodium chloride, and combinations thereof The mixture can contain up to 70% by weight filler or grinding aid, typically up to 40% by weight, and preferably from 1 to 10% by weight, most preferably from 1 to 5% by weight.

A preferred mixture for making the abrasive coating for the products of the present invention comprises 19.47 parts by weight trimethylolpropane triacrylate available under the trade designation SR 351 from Sartomer Company, Exton, Pa., 12.94 parts by weight 2-phenoxyethyl acrylate available under the trade designation SR 339 from Sartomer Company, 3.08 parts by weight dispersant available under the trade name Zephrym™ PD 9000, 1.08 part by weight ethyl 2,4,6-trimethylbenzoylphenyl-phosphinate available under the former trade designation Lucirin™ LR 8893 (now under the trade designation Lucirin™ TPO-L) from BASF as a photoinitiator, 1.93 part by weight gamma-methacryloxypropyltrimethoxy silane available under the trade designation Silques™ A-174™ Silane from Witco, Corp., Greenwich, Conn., as a resin modifier and 61.50 parts by weight grade GC 3000 green silicon carbide abrasive particles having an average particle size of 4.0 μm available from Fujimi Abrasives Company, based on 100.00 parts by weight total.

The mixture can be prepared by mixing the ingredients, preferably by a low shear mixer. A high shear mixer can also be used. Typically, the abrasive particles are gradually added into the binder precursor. Additionally, it is possible to minimize the amount of air bubbles in the mixture. This can be accomplished by pulling a vacuum during the mixing step.

During the manufacture of the shaped, handleable structure, radiation energy is transmitted through the production tool and into the mixture to at least partially cure the binder precursor. The phrase "partial cure" means that the binder precursor is polymerized to such a state that the resulting mixture releases from the production tool. The binder precursor can be fully cured once it is removed from the production tool by any energy source, such as, for example, thermal energy or radiation energy. The binder precursor can also be fully cured before the shaped, handleable structure is removed from the production tool.

Sources of radiation energy preferred for this invention include electron beam, ultraviolet light, and visible light. Other sources of radiation energy include infrared and microwave. Thermal energy can also be used. Electron beam radiation, which is also known as ionizing radiation, can be used at a dosage of about 0.1 to about 10 Mrad, preferably at a dosage of about 1 to about 10 Mrad. Ultraviolet radiation refers to non-particulate radiation having a wavelength, within the range of about 200 to 400 nanometers, preferably within the range of about 250 to 400 nanometers. It is preferred that ultraviolet radiation be provided by ultraviolet lamps operating in a range of 100 to 300 Watts/cm. Visible radiation refers to non-particulate radiation having a wavelength within the range of about 400 to about 800 nanometers, preferably within the range of about 400 to about 550 nanometers.

In the method of this invention, the radiation energy is transmitted through the production tool and directly into the mixture. It is preferred that the material from which the production tool is made not absorb an appreciable amount of radiation energy or be degraded by radiation energy. For example, if electron beam energy is used, it is preferred that the production tool not be made from a cellulosic material, because the electrons will degrade the cellulose. If ultraviolet radiation or visible radiation is used, the production tool material should transmit sufficient ultraviolet or visible radiation, respectively, to bring about the desired level of cure.

The production tool should be operated at a velocity that is sufficient to avoid degradation by the source of radiation. Production tools that have relatively high resistance to degradation by the source of radiation can be operated at relatively lower velocities; production tools that have relatively low resistance to degradation by the source of radiation can be operated at relatively higher velocities. In short, the appropriate velocity for the production tool depends on the material from which the production tool is made.

The production tool can be in the form of a belt, e.g., an endless belt, a sheet, a continuous sheet or web, a coating roll, a sleeve mounted on a coating roll, or die. The surface of the production tool that will come into contact with the mixture has a topography or pattern. This surface is referred to herein as the "contacting surface." If the production tool is in the form of a belt, sheet, web, or sleeve, it will have a contacting surface and a non-contacting surface. If the production tool is in the form of a coating roll, it will have a contacting surface only. The topography of the abrasive article formed by the method of this invention will have the inverse of the pattern of the contacting surface of the production tool. The pattern of the contacting surface of the production tool will generally be characterized by a plurality of cavities or recesses. The opening of these cavities can have any shape, regular or irregular, such as a rectangle, semicircle, circle, triangle, square, hexagon, octagon, etc. The walls of the cavities can be vertical or tapered. The pattern formed by the cavities can be arranged according to a specified plan or can be random. The cavities can butt up against one another.

Thermoplastic materials that can be used to construct the production tool include polyesters, polycarbonates, poly (ether sulfone), poly(methyl methacrylate), polyurethanes, polyvinylchloride, polyolefins, polystyrene, or combinations thereof Thermoplastic materials can include additives such as plasticizers, free radical scavengers or stabilizers, thermal stabilizers, antioxicants, and ultraviolet radiation absorbers. These materials are substantially transparent to ultraviolet and visible radiation. One type of production tool is described in U.S. Pat. No. 5,435,816. Examples of materials forming the production tool include polycarbonate and polyester. The material forming the production tool should exhibit low surface energy. The material of low surface energy improves ease of release of the abrasive article from the production tool. Examples of materials suitable include polypropylene and polyethylene. In some production tools made of thermoplastic material, the operating conditions for making the abrasive article should be set such that excessive heat is not generated. If excessive heat is generated, this may distort or melt the thermoplastic tooling. In some instances, ultraviolet light generates heat. It should also be noted that a tool consisting of a single layer is also acceptable, and is the tool of choice in many instances. A thermoplastic production tool can be made according to the procedure described in U.S. Pat. No. 5,435,816.

Figure 11:
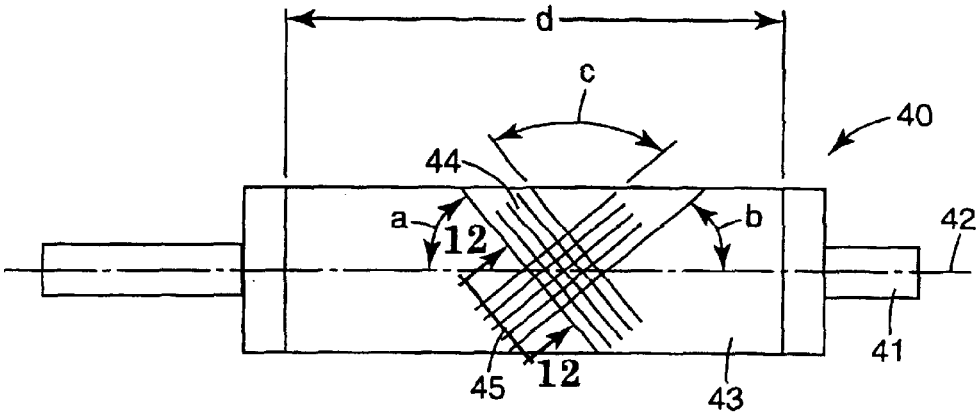
FIG. 11 is a top plan view of a roller for making a production tool useful for making the shaped abrasive layer of articles according to the present invention.

FIG. 11 shows a roller 40 that was used for making production tool 11 as depicted in FIG. 1. The following specific embodiment of roller 40 was used to make production tool 11 which was then used to make Examples 1–6 of the invention. Roller 40 has a shaft 41, an axis of rotation 42 and a patterned surface 43 over a major portion of its cylindrical surface. The length of the patterned surface is d which may vary according to the user's requirements. The patterned surface 43 includes 2 identical sets 44 and 45 of repeating equally spaced grooves, with grooves in set 44 being deployed in a direction perpendicular to grooves in set 45 with angle c being 90°. In this embodiment angle a is 50° with respect to the axis of rotation 42 and angle b is 40° with respect to the axis of rotation.

Figure 12:
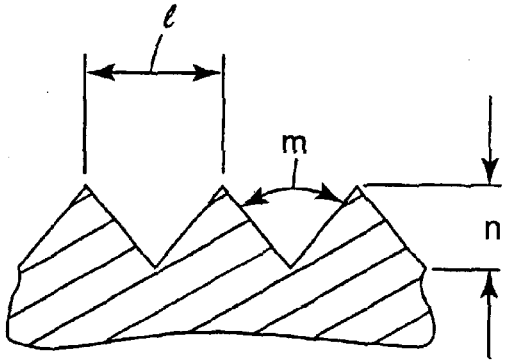
FIG. 12 is an enlarged sectional view of a segment of the surface of the roller depicted in FIG. 11 taken at line 12—12 to show surface detail.

FIG. 12 provides an enlarged cross sectional view of a segment of patterned surface 43 taken at line 12—12 in FIG. 11 perpendicular to one set of grooves. In this case, the peak to peak distance, l, is 0.0.0042 inch (0.107 mm) and the valley to peak distance, n, is 0.025 inch (0.064 mm). The angle between adjacent peak slopes, m, is 80°.

Roller 40 was used to make a production tool of the type described above to impart a shaped surface to the abrasive articles depicted in FIGS. 3, 4 and 7–10.

Figure 13:
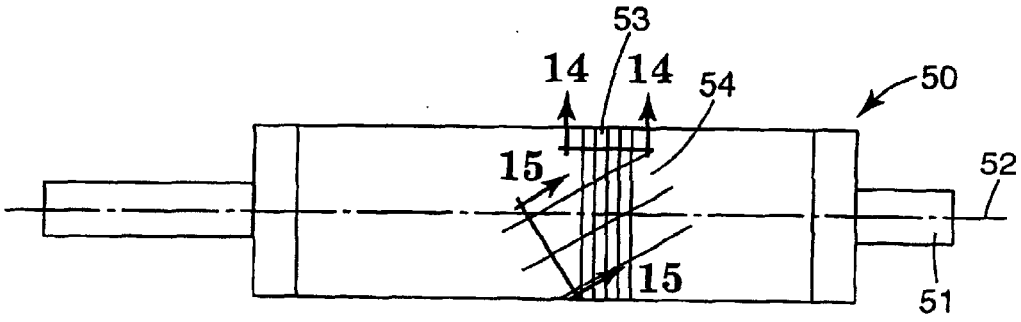
FIG. 13 is a top plan view of another roll useful for making a production tool to make the shaped abrasive layer of articles of the present invention.

An alternative roller 50 is depicted in FIG. 13 which includes a shaft 51 and an axis of rotation 52. In this case the patterned surface includes a first set 53 of adjacent circumferential grooves around the roller and a second set 54 of equally spaced grooves deployed at an angle of 30° with respect to the axis of rotation 52.

Figure 14:
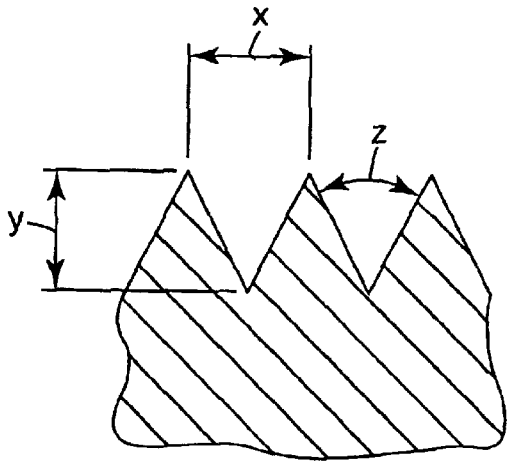
FIG. 14 is an enlarged sectional view of one segment of the patterned surface of the roll depicted in FIG. 13 taken at line 14—14.

FIG. 14 shows an enlarged cross sectional view of a segment of the patterned surface of roller 50 taken at line 14—14 in FIG. 13 perpendicular to the grooves in set 53. FIG. 14 shows the patterned surface has peaks spaced by distance x which is 50 $\mu$m apart peak to peak and a peak height, y, from valley to peak of 50 $\mu$m, with an angle z which is 53° angle between adjacent peak slopes.

Figure 15:
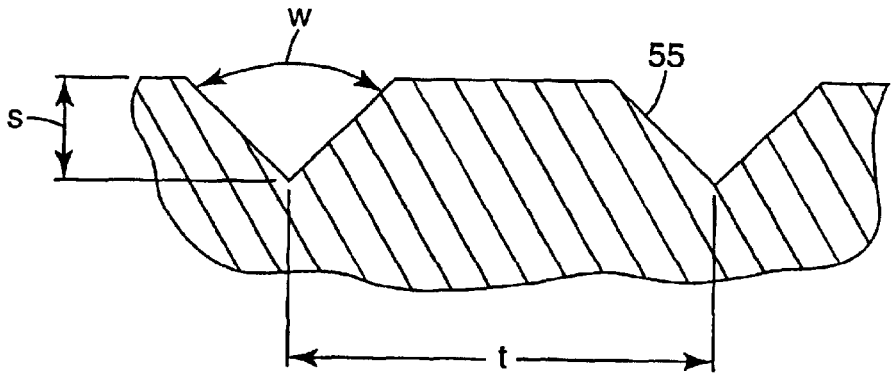
FIG. 15 is an enlarged sectional view of another segment of the patterned surface of the roll depicted in FIG. 13, taken at line 15—15.

FIG. 15 shows an enlarged cross sectional view of a segment of the patterned surface of roller 50 taken at line 15—15 in FIG. 13 perpendicular to the grooves in set 54. FIG. 15 shows grooves 55 having an angle w which is a 90° angle between adjacent peak slopes and valleys separated by a distance t which is 250 $\mu$m and a valley depth s which is 55 $\mu$m.

Roller 50 is also useful for producing a preferred production tool for use in the process depicted in FIG. 1.

The flexible abrasive product of the present invention is typically used in surface finishing applications with a sanding device such as a dual action sander. A useful dual action sander is that sold by Dynabrade Inc. of Clarence, N.Y. under the trade designation Dynorbital™ sander model number 56964. Such a sander typically requires a sanding pad having a surface to which the flexible abrasive product of the invention will be mounted. A preferred pad surface typically includes one part of a two part attachment surface such as a looped fabric to which a backing bearing hooks or flattened stems on the backside of the abrasive product will engage. A preferred backing for this purpose is known under the trade designation Hookit™ II laminating backing made available in abrasive products sold, for example, under the trade designation 3M™ Hookit™ II Finishing Film Discs by Minnesota Mining and Manufacturing Company, St. Paul, Minn.

Workpiece

The workpiece can be any of a variety of types of material such as painted surfaces (clear coat, base (color) coat, primer or e-primer) coated surfaces (polyurethane, lacquer, etc), plastics (thermoplastic, thermosetting), reinforced plastics, metal, (carbon steel, brass, copper, mild steel, stainless steel, titanium and the like) metal alloys, ceramics, glass, wood, wood-like materials, composites, stones (including gem stones), stone-like materials, and combinations thereof The workpiece may be flat or may have a shape or contour associated with it. Examples of common workpieces that may be polished by the abrasive article of the invention include painted automotive surfaces (car doors, hoods, trunks, etc.), plastic automotive components (headlamp covers, tail-lamp covers, other lamp covers, arm rests, instrument panels, bumpers, etc.), flooring (vinyl, stone, wood and wood-like materials), counter tops, other plastic components and the like.

Depending upon the application, the force load at the polishing interface may range from about 0.01 kg to over 25 kg. Generally, this range is between 1 kg to 15 kg of force load at the polishing interface. Also, it is preferred to have a liquid present during polishing. The liquid may be water and/or an organic compound. These liquids may also contain other additives such as defoamers, degreasers, lubricants, soaps, corrosion inhibitors, or the like. The abrasive article may oscillate at the abrading interface during use.

At least one or both of the abrasive article and the workpiece is moved relative to the other. The abrasive disc may range from about 50 mm to 1,000 mm in diameter. Typically, abrasive discs are secured to a back-up pad by an attachment means. The attachment means may be a hook and loop type attachment, where the hooks may be on the back side of the abrasive article and the loops on the support pad or vice versa. Alternatively, the attachment system may be a pressure sensitive adhesive. The abrasive discs typically rotate between 100 to 20,000 revolutions per minute, usually between 1,000 to 10,000 revolutions per minute. The back up pad may rotate in a circular fashion, orbital fashion or random orbital fashion. Alternatively, the abrasive article of the invention may be used by hand.

EXAMPLES

The invention is further illustrated by the following examples wherein all parts and percentages are by weight unless otherwise indicated.

Identification of Ingredients

"HyCar™ 2679" is an acrylic latex obtained from BF Goodrich Specialty Chemicals, Inc., Cleveland, Ohio containing about 50% by weight acrylic polymer solids in an aqueous medium which includes trace quantities of formaldehyde.

"Carbopol™ EZ-1" is an acrylic resin powder comprised of crosslinked acrylic acid polymer used as a thickener obtained from BF Goodrich Specialty Chemicals, Inc., Cleveland, Ohio.

"Ammonium Hydroxide Solution" is an aqueous solution of ammonium hydroxide containing 29.5% by weight $NH_3$.

"3M Fluorad™ Fluorosurfactant FC-129" is an anionic surfactant consisting of 50% by weight potassium fluoroalkyl carboxylates dissolved in 14% by weight 2-butoxyethanol, 4% by weight ethyl alcohol and 32% by weight water obtained from Minnesota Mining and Manufacturing Company (3M) of St. Paul, Minn.

"Hookit™ II Laminating Backing" is one part of a 2-part fastening system comprising sheet material bearing on one side a multiplicity of erect stems that have flattened distal ends that is made according to U.S. Pat. No. 5,667,540 and manufactured by 3M Company of St. Paul, Minn. The flattened stems are engageable in a fabric material which provides the other part of 2-part fastening system, as described in U.S. Pat. No. 5,962,102. The Hookit™ II laminating backing is mounted on the backside of an abrasive pad by an adhesive coating on its backside which is brought into contact with the backside of the abrasive pad.

"SR 351" is trimethylolpropane triacrylate monomer having a molecular weight of 296 and functionality of 3 available under the designation SR-351 from Sartomer Company, Exton, Pa.

"SR 339" is 2-Phenoxyethyl acrylate aromatic monomer having a molecular weight of 192 and functionality of 1 available under the designation SR-339 from Sartomer Company, Exton, Pa.

"PD 9000" is a polymeric disperant available under the trade designation Zephrym™ PD 9000 (formerly known as Hypermer PS-4) from Uniqema an international business of Imperial Chemical Industries PLC.

"A-174™" is gamma-methacryloxypropyltrimethoxy silane resin modifier available under the trade designation SILQUEST™ A-174™ silane from Witco Corporation, Greenwich, Conn.

"TPO-L" is ethyl 2,4,6-trimethylbenzoylphenylphosphinate photoinitiator available under the trade designation LUCIRIN™ TPO-L (formerly known as LUCIRIN™ LR 8893) from BASF Corp., Charlotte, N.C.

"Green SiC" is green silicon carbide abrasive particles having a grade size of GC 3000 and an average particle size of 4.0 $\mu$m as determined by Coulter™ Counter available under the trade designation FUJIMI GC 3000 from Fujimi Abrasives Company, Elmhurst, Ill.

Table 1 shows the trade designations for open cell polyester polyurethane foams obtained from illbruck, Inc., Minneapolis, Minn.:

TABLE 1

| | Bulk Density | | Tensile Strength | | Elongation |
|---|---|---|---|---|---|
| Designation | (lb/ft$^3$) | (kg/m$^3$) | (psi) | (kg/cm$^2$) | (%) |
| "R 200U" | 1.8–2.0 | 29–32 | 19.0 | 1.3 | 100 |
| "R 400U" | 4.0 ± 0.4 | 64 ± 6 | 20.0 | 1.4 | 100 |
| "R 600U" | 6.0 ± 0.6 | 96 ± 10 | 16.0 | 1.1 | 150 |
| "PPF 8" | 2.2–2.7 | 34–38 | 66.1 | 4.6 | 173 |

"EF3-700C" is the trade designation of illbruck, Inc., Minneapolis, Minn. for a felted, polyether foam felted at a ratio of 3:1 to its thickness. The EF3-700C foam has a bulk density of 1.65–1.9 lb/ft$^3$ (26–30 kg/m$^3$), a tensile strength of 12 psi (0.8 kg/cm$^2$), an elongation of 85%.

The air permeability values of various open cell foam samples, both uncoated and coated with a barrier coat, were determined by use of the Frazier™ air permeability measuring instrument described above. These values are set forth in Table 2.

TABLE 2

| Manufacturer's Product Code | Coating Weight: Dry Hycar ™ 2679 Grain 4 × 6[1] | Coating Weight: Dry Hycar ™ 2679 gsm | Coat Method | Permeability: $Ft^3$ Air/Min/$Ft^2$ of Sample @ 0.5" Water | Permeability: $M^3$ Air/Min/$M^2$ of Sample @ 12.7 mm Water |
|---|---|---|---|---|---|
| EF3-700C-188 | 13.9 | 58.2 | Roll | 17. | 5.92 |
| EF3-700C-188 | 14.5 | 60.7 | Roll | 14.6 | 5.08 |
| EF3-700C-188 | 15.9 | 66.5 | Roll | 10. | 3.48 |
| EF3-700C-188 | 16.3 | 68.2 | Roll | 11.8 | 4.11 |
| EF3-700C-188 | 20.0 | 83.7 | Roll | 8. | 2.78 |
| EF3-700C-188 | 22.1 | 92.5 | Roll | 11.8 | 4.11 |
| EF3-700C-188 | 22.5 | 94.2 | Roll | 8.1 | 2.82 |
| EF3-700C-188 | 23.4 | 97.9 | Spray | 15.7 | 5.46 |
| EF3-700C-188 | 23.4 | 97.9 | Spray | 16.8 | 5.85 |
| EF3-700C-188 | 24.0 | 100.4 | Roll | 6.7 | 2.33 |
| EF3-700C-188 | 24.0 | 100.4 | Roll | 6.6 | 2.30 |
| EF3-700C-188 | 24.4 | 102.1 | Roll | 6.7 | 2.33 |
| EF3-700C-188 | 25.0 | 104.6 | Roll | 8.9 | 3.10 |
| EF3-700C-188[2] | 42.0 | 175.8 | Knife | 0.143 | 0.05 |
| EF3-700C-188 | None | None | | 14.9 | 5.19 |
| EF3-700C-188 | None | None | | 14.9 | 5.19 |
| EF3-700C-188 | None | None | | 16.8 | 5.85 |
| R200U-188 | 37.6 | 157.4 | Roll | 111. | 38.63 |
| R200U-188 | 39.2 | 164.1 | Roll | 113. | 39.32 |
| R200U-188 | 41.8 | 174.9 | Roll | 98. | 34.10 |
| R200U-188 | None | None | | 434. | 151.03 |
| R400U-188 | 15.9 | 66.5 | Spray | 13.8 | 4.80 |
| R400U-188 | 15.9 | 66.5 | Spray | 22.2 | 7.73 |
| R400U-188 | 23.4 | 97.9 | Spray | 28.1 | 9.78 |
| R400U-188 | 23.4 | 97.9 | Spray | 18.1 | 6.30 |
| R400U-188 | 23.9 | 100.0 | Roll | 17.2 | 5.99 |
| R400U-188 | 27.5 | 115.1 | Roll | 18.9 | 6.58 |
| R400U-188 | 29.4 | 123.0 | Roll | 18.4 | 6.40 |
| R400U-188 | None | None | | 22.5 | 7.83 |
| R600U-090 | 15.9 | 66.5 | Spray | 20.2 | 7.03 |
| R600U-090 | 23.4 | 97.9 | Spray | 39.8 | 13.85 |
| R600U-090 | 23.4 | 97.9 | Spray | 31.5 | 10.96 |
| R600U-090 | 41.5 | 173.7 | Roll | 81. | 28.19 |
| R600U-090 | 45.1 | 188.7 | Roll | 90. | 31.32 |
| R600U-090 | 51.1 | 213.9 | Roll | 90. | 31.32 |
| R600U-090 | None | None | | 214. | 74.47 |
| R600U-125 | 15.9 | 66.5 | Spray | 13.3 | 4.63 |
| R600U-125 | 15.9 | 66.5 | Spray | 16.6 | 5.78 |
| R600U-125 | 23.4 | 97.9 | Spray | 12.6 | 4.38 |
| R600U-125 | 34.1 | 142.7 | Roll | 44.7 | 15.56 |
| R600U-125 | 34.5 | 144.4 | Roll | 55.1 | 19.17 |
| R600U-125 | 37.3 | 156.1 | Roll | 54.4 | 18.93 |
| R600U-125 | None | None | | 114. | 39.67 |
| R600U-188 | 40.9 | 171.2 | Roll | 12.7 | 4.42 |
| R600U-188 | 41.8 | 174.9 | Roll | 41.4 | 14.41 |
| R600U-188 | 42.6 | 178.3 | Roll | 55.7 | 19.38 |
| R600U-188 | 43.1 | 180.4 | Roll | 41.5 | 14.44 |
| R600U-188 | 45.6 | 190.8 | Roll | 35. | 12.18 |
| R600U-188 | None | None | | 189. | 65.77 |

[1]The test sample was 4 inches by 6 inches (about 5 cm by 7.5 cm).
[2]Open cell foam was coated with an impervious barrier coat.

Examples 1–6 and Comparative Examples A–C

Examples 1–6 and Comparative Examples A–C demonstrate the advantages of the inventive abrasive articles when employed to refine the surface of painted automotive panels. The compositions of Examples 1–6 and Comparative Example A are shown in Table 3.

A barrier coating composition consisting of 100% HYCAR™ 2679 was employed in the roll coating and spray coating processes to make foraminous barrier coatings. When the knife coating process was employed, a thickened barrier coating composition further consisting of 91.120% HYCAR™ 2679, 5.304% water, 0.152% FLUORAD™ FC 129, 3.152% CARBOPOL™ EZ-1 (4% in water), and 0.273% ammonium hydroxide solution was used to apply an impervious barrier coating. The selected barrier coating composition was applied to each foam backing by either a roll coating process, a spray coating process, or a knife coating process as indicated in Table 3.

The roll coating process was used to generate a foraminous barrier coat and employed 7.6 cm diameter rolls (one with a rubber surface and one with a steel surface) gapped to about 0.38 mm less than the thickness of the foam to be coated. The coating pan was filled with the barrier coating composition and the coater set to operate at 3 to 4.5 n/min. The various foam backing sheets (1 m×0.3 m) were then introduced into the nip.

Upon exiting the nip area, each coated backing was impinged by an air flow to break any bubbles resulting from the coater. The sheets were then placed in an oven set at 120–150° C. for about 6 minutes.

The spray coating process was used to generate a foraminous barrier coat and employed a conveyor belt traversing under a reciprocating spray nozzle and subsequent radiant heater sufficient to achieve a temperature at the backing surface of about 120° C. The conveyor speed was controlled to provide the required add-on as reported in Table 3.

The knife coating process was used to generate impervious barrier coatings on selected backings. The 1 m×0.3 m foam backing specimens were drawn by hand at about 10 m/minute through a knife coater having the coating knife adjusted to barely touch the backing surface. An approximate 50 ml aliquot of thickened barrier coating composition was placed before the leading edge of the knife. The knife position was adjusted to achieve the required add-on. The coated backing was then placed in an oven set at 150° C. for about 6 minutes.

After the appropriate barrier coating was applied, an abrasive slurry formed by mixing 19.47 parts SR 351, 12.94 parts SR 339, 3.08 parts PD 9000, 1.93 part A-174™, 1.08 part TPO-L, and 61.50 parts Green SiC was applied. The slurry was applied via knife coating to a polypropylene tool having a patterned surface, the patterned surface being the reverse pattern of that desired for the shaped abrasive surface, and being made by use of a pattern roll depicted in FIGS. 11 and 12. The coated tool was then applied to the coated foam backing so that contact is established between the coating of the backing and the slurry side of the tool. The tool side of the resulting lamination was then exposed to ultraviolet radiation by exposure to a D-bulb at high power (600 Watts per inch) (236 Watts per cm) while moving the web at 30 feet per minute (9.14 m/minute) at a nip pressure of 50 psi (3.52 kg/cm$^2$) for a 10 inch (25 cm) wide web. The tooling was then removed from the resulting partially-cured shaped abrasive coating on the barrier coated backing. In the event that the barrier coating was foraminous, this process of removing the tool caused at least part of the shaped abrasive layer in at least some of the tool cavities to remain in the polypropylene tool, thereby creating a shaped abrasive layer with irregular openings. Alternatively, in the case of the barrier coating being impervious, at least most of the shaped abrasive layer was successfully transferred from the tool cavities to the barrier coating, thereby creating a more uniform shaped abrasive layer.

Example 6 was further needle tacked to render foraminous the otherwise impervious barrier coated article. The abrasive composition was needled from the abrasive side with a staggered 20×20 array of needles (Foster 15×18×25×3.5 RB) deployed in a standard needle board with rows and columns being spaced ½ inch (1 cm) apart and operated at 37 strokes per 10 inch (25 cm) length (1.46 stroke per cm) to provide about 148 penetrations per square inch (23 penetrations per cm$^2$). Such needles and needle board may be obtained from Foster Needle Company, Inc., Manitowoc, Wis. Needle tacking provided the requisite porosity for the successful employment of the otherwise unacceptable abrasive article, as indicated by comparison with Comparative Example A, that is identical to Example 6, but without the needling step.

The resulting abrasive products were then ready for conversion to six inch (15 cm) diameter discs for comparative testing.

Examples 7–9

Examples 7–9 demonstrate the preparation and efficacious performance of abrasive articles of the present invention when made using convoluted open cell foam backings.

Examples 7–9 were made according to the procedure described for Examples 1–6 employing roll coating to provide the barrier coating except for the use of a production tool having a different geometry from that of the previous examples. Example 7 used a polyester polyurethane open cell foam backing with planar major surfaces available from illbruck, Inc. as "R600U-090." Examples 8 and 9 used a convoluted polyester polyurethane open cell foams "PPF8" and "R400U," respectively, having an array of 20 mm base diameter, 2 mm high projecting portions on the first major surface spaced 25 mm apart, and a thickness measured from the distal ends of the projection on the first major surface to the second major surface of 5 mm. The second major surface was essentially planar. The convoluted foam for Examples 8 and 9 was obtained from illbruck under the illbruck designation "Mini-Standard." Examples 7–9 are further described in Table 3. Comparative test results are reported in Table 4.

TABLE 3

| Example | Foam Backing | Barrier Coat | Barrier Coating wt, g/m$^2$ (dry) | Shaped Abrasive Coating wt, g/m$^2$ | Needled |
|---|---|---|---|---|---|
| 1 | EF3-700C-188 | Roll coat | 100–121 | 66 | No |
| 2 | R600U-125 | Spray coat | 98 | 60–67 | No |
| 3 | R600U-90 | Spray coat | 67 | 60–67 | No |
| 4 | R400U-188 | Spray coat | 98 | 60–67 | No |
| 5 | R200U-188 | Roll coat | 167 | 65 | No |
| 6 | EF3-700C-188 | Knife coat | 176 | 90 | Yes |
| 7 | R600U-090 | Roll coat | 92 | 60–67 | No |
| 8 | Mini-Standard | Roll coat | 65 | 36 | No |
| 9 | Mini-Standard | Roll coat | 90 | 55 | No |
| Comparative A | EF3-700C-188 | Knife coat | 176 | 90 | No |

Comparative Example B

Comparative Example B was a 6 inch diameter (15 cm) abrasive finishing disc available under the trade designation Abralon™ 2000 from Mirka Abrasives Incorporated, Twinsburg, Ohio.

Comparative Example C

Comparative Example C was a 6 inch diameter (15 cm) abrasive finishing disc available under the trade designation BUFLEX™ PN 192-1501 from Eagle Abrasives Norcross, Ga.

Product Testing

Materials

AOEM clear coated black painted cold roll steel test panels obtained from Advanced Coating Technologies Laboratories, Inc., Hillsdale, Mich. having dimensions of 18 inches by 24 inches (45.7 cm by 61 cm).

Fine finish orbital sander available from Dynabrade, Inc. of Clarence, N.Y. under the trade designation Dynorbital™ Model No. 56964 equipped with a 3M™ Hookit™ II 6 inch (15.2 cm) diameter backup pad.

Water spray bottle.

Stopwatch.

Profilometer available from Federal Products Corporation an Esterline Company of Providence, R.I. under the trade designation Pocket Surf™ profilometer.

Panel Preparation

The painted panels deployed horizontally in their long dimension were first prepared by sanding their surfaces using the fine finish sander and 3M Hookit™ II Finishing Film Discs, grade P1500, available from 3M Company under the trade designation 3M™ Hookit™ II Finishing Film Discs. The orbital sander was operated at a line pressure of 50 psi (3.52 kg/cm$^2$) using moderate but consistent downward pressure. Each sweep of the sander was overlapped by 50% with the pad half off the panel on the first and last sweep. Sanding was started in the upper left hand corner of the test panel and the sanding pad was moved back and forth across the panel, moving from top to bottom, ending at the lower right corner after a total of seven sweeps. The sander was then moved in a reverse pattern, back up the panel in seven sweeps, ending at the starting point. The same sanding disc was then moved in a vertical path from the upper left corner, sweeping vertically, moving from left to right ending, after nine sweeps, at the lower right hand panel corner. The sander was then moved in a reverse pattern, back across the panel in nine sweeps, ending at the starting point. A new P 1500 abrasive disc was then used, starting at the lower right panel corner and finishing at the upper left corner after seven horizontal sweeps. The sander was moved from the upper left corner horizontally moving back down the panel, ending at the lower right corner after seven sweeps. Sanding then proceeded from the lower right corner vertically across the panel, ending at the upper left corner after nine sweeps. Finally, sanding was continued vertically, starting at the upper left corner, moving from left to right, ending at the lower right in nine sweeps.

Initial Finish of Prepared Panel

Using the profilometer, the Rz in the vertical center of each vertical one-third of the panel was read. Five readings were taken in each one-third of a panel at 3 inches (7.6 cm) above and below the vertical center and at the vertical center. The average of these readings was the initial Rz for the prepared test panel.

Abrasive Product Evaluation

The test abrasive products were converted into a six inch (15.2 cm) diameter pads to which was applied the 3M Hookit™ II attachment part that was engageable to its mating part on the support pad of the fine finish sander. The test pad was mounted on the support pad of the sander and was used to finish the prepared panel. The panel was considered to have 3 equal sized vertical portions. Water was sprayed over the panel in a sufficient amount to prevent chattering or sticking of the product to the panel. One test disc was used on each panel. Sanding was in a vertical direction in each one-third panel part under an applied constant hand pressure. The left most one-third portion was sanded for 10 seconds, the middle portion for 20 seconds and the right portion for 30 seconds. There panels were sanded for each test product. The $R_z$ of each sanded portion was measured in each vertical portion at 5 points, at the vertical center, 1.5 inch (3.8 cm) above and below vertical center and 3.0 inches (7.6 cm) above and below the vertical center. The average $R_z$ for each sanding time is then reported with the initial $R_z$. The results are shown in Table 4.

TABLE 4

| | $R_z$ Following Various Sanding Times | | | | |
|---|---|---|---|---|---|
| Example | 0 sec | 10 sec | 20 sec | 30 sec | Stick to panel? |
| 1 | 37.9 | 15.7 | 13.6 | 14.4 | No |
| 2 | 37.3 | 16.8 | 12.3 | 13.6 | No |
| 3 | 37.6 | 16.3 | 14.9 | 14.9 | No |
| 4 | 37.2 | 16.8 | 13.3 | 15.5 | No |
| 5 | 37.7 | 19.5 | 16.8 | 15.7 | No |
| 6 | 37.5 | 16.5 | 13.1 | 13.6 | No |
| 7 | 34.3 | 10.9 | 8.8 | 8.8 | No |
| 8 | 33.5 | 13.3 | 10.9 | 10.9 | No |
| 9 | 33.6 | 12.0 | 10.1 | 11.2 | No |
| Comparative A | 37.8 | 18.9 | 12.8 | 14.4 | Yes |

TABLE 4-continued

| | $R_z$ Following Various Sanding Times | | | | |
|---|---|---|---|---|---|
| Example | 0 sec | 10 sec | 20 sec | 30 sec | Stick to panel? |
| Comparative B | 37.8 | 42.5 | 34.0 | 31.2 | No |
| Comparative C | 37.5 | 21.6 | 17.3 | 14.1 | Yes |

It can be seen that the abrasive products of the present invention provide a lower $R_z$ faster comparatives B and C. The products of the invention are also easier to handle during use.

The present invention has now been described with reference to several embodiments thereof It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

We claim:

1. A method of making an abrasive article, said method comprising the following steps:

a. applying a curable barrier coating over a first major surface of an open cell foam backing which also has un opposite second major surface;

b. curing said curable barrier coating to provide on said first major surface a foraminous barrier coating having openings therethrough corresponding to openings in said open cell foam;

c. applying a coating composition comprising a curable binder and abrasive particles over said foraminous barrier coating;

d. imparting a textured-surface to the coating composition applied in step c with a production tool that has a textured surface which is the inverse of the textured surface of the abrasive coating;

e. at least partially curing the binder; and f. separating the production tool from the textured surface to provide said shaped foraminous abrasive coating characterized by having openings there through corresponding to at least some of the openings in the open cell foam.

2. The method of claim 1 wherein said first surface is coated with a foraminous barrier coat having a dry coat weight of at least about 50 grams per square meter.

3. The method of claim 2 wherein said dry coat weight is in the range of about 65 to about 180 grams per square meter.

4. The method of claim 1 wherein said barrier coated open cell backing has an air permeability of at least about 1 m$^3$/minute/m$^2$.

5. The method of claim 4 wherein said air permeability is in the range of about 2 to about 50 m$^3$/minute/m$^2$.

6. The method of claim 1 further comprising applying an attachment means on said second major surface.

7. A method of making a flexible abrasive product comprising an open cell foam having a first major surface coated with a foraminous barrier coating and a shaped foraminous abrasive coating over the foraminous barrier coating, the method comprising the following steps:

a. coating a curable barrier coating composition which will cure to form an impervious coating on the first major surface of the open cell foam;

b. curing the curable barrier coating composition to provide an impervious barrier coating;

c. applying a coating composition comprising abrasive particles and curable binder curable to provide an abrasive coating over the cured impervious barrier coating;

d. imparting a textured surface to the uncured coating composition of step c;

e. curing the coating composition to provide a shaped abrasive coating over the impervious barrier coating; and f. perforating the impervious barrier coating and shaped abrasive coating to provide the flexible abrasive product having the foraminous barrier coating and the foraminous shaped abrasive coating.

8. The method of claim 7 wherein said first surface is coated with an impervious barrier coat having a dry coat weight of at least about 150 grams per square meter.

9. The method of claim 8 wherein said dry coat weight is in the range of about 160 to about 190 grams per square meter.

10. The method of claim 7 wherein said open cell foam has an opposite second major surface and further comprising applying an attachment means on said second major surface.

11. A method of finishing a surface of a substrate, said method comprising the following steps:

a. contacting a surface of the substrate with a flexible abrasive article comprising an open cell foam backing having a first major surface and an opposite second major surface; a foraminous barrier coating over said first major surface; and a shaped foraminous abrasive coating over said foraminous barrier coating comprised of abrasive particles in a binder; and b. relatively moving said flexible abrasive article in the presence of a liquid medium to modify said surface of said substrate.

12. The method according to claim 11 wherein said liquid medium comprises water.

13. The method according to claim 11 wherein said substrate comprises a painted surface.

* * * * *

UNITED STATES PATENT AND TRADEMARK OFFICE

CERTIFICATE OF CORRECTION

PATENT NO. : 6,923,840 B2
APPLICATION NO. : 10/919840
DATED : August 2, 2005
INVENTOR(S) : James W. Schutz It is certified that error appears in the above-identified patent and that said Letters Patent is hereby corrected as shown below:

Column 3
Line 56, delete “therethough” and insert in place thereof -- therethrough -- .

Column 4
Line 19, After “product” delete “:”.

Column 6
Line 43, delete “ire.,” and insert in place thereof -- i.e., --.

Column 10
Line 5, after “thereof” insert -- . --.

Line 27, after “thereof” insert -- . --.

Column 12
Line 9 (approx.), after “thereof” insert -- . --.

Line 26, delete “Silques™” and insert in place thereof -- Silquest™ --.

Column 13
Line 45, after “thereof insert in place thereof -- . --.

Column 15
Line 2, after “thereof” insert in place thereof -- . --.

Column 18
Line 59, delete “n/min.” and insert in place thereof -- m/min. --.

Lines 62-65, below “nip.” delete “Upon exiting the nip area, each coated backing was impinged by an air flow to break any bubbles resulting from the coater. The sheets were then placed in an oven set at 120-150° C. for about 6 minutes.” Insert the same paragraph on line 61, after “nip.”.

Column 20
Line 43 (approx.), after “Abrasives” insert -- Incorporated, --.

Column 21
Line 46, delete “There” and insert in place thereof -- Three --.

Line 49, after “Abrasives” insert -- the --.

UNITED STATES PATENT AND TRADEMARK OFFICE

CERTIFICATE OF CORRECTION

PATENT NO. : 6,923,840 B2
APPLICATION NO. : 10/919840
DATED : August 2, 2005
INVENTOR(S) : James W. Schutz It is certified that error appears in the above-identified patent and that said Letters Patent is hereby corrected as shown below:

Column 22

Line 11, after "faster" insert -- than --.

Line 15, after "thereof" insert -- . --.

Line 26, claim 1, delete "un" and insert in place thereof -- an --.

Line 36, claim 1, delete "textured-surface" and insert in place thereof -- textured surface --.

Line 43 (approx.), claim 1, delete "there through" and insert in place thereof
-- therethrough --.

Signed and Sealed this

Eighteenth Day of December, 2007

JON W. DUDAS
*Director of the United States Patent and Trademark Office*